US005382088A

United States Patent [19]

Young

[11] Patent Number: 5,382,088

[45] Date of Patent: Jan. 17, 1995

[54] SITE ERECTABLE CABINET

[76] Inventor: Nelson Young, 112 Cuba Hill Rd., Greenlawn, N.Y. 11740

[21] Appl. No.: 13,586

[22] Filed: Feb. 4, 1993

[51] Int. Cl.[6] ..... A47B 47/00

[52] U.S. Cl. ..... 312/263; 312/265.5

[58] Field of Search ..... 312/263, 265.1, 265.5, 312/108, 109, 348.3; 40/603; 52/222

[56] References Cited

U.S. PATENT DOCUMENTS

| | | | |
|---|---|---|---|
| 3,422,565 | 1/1969 | Kentfield et al. | 312/265.1 |
| 3,675,981 | 7/1972 | Mallander | 312/265.1 |
| 4,053,192 | 10/1977 | Spetner | 312/265.5 |
| 4,187,649 | 2/1980 | Chaffee | 312/265.1 X |
| 4,583,331 | 4/1986 | Hunt et al. | 52/2 |
| 4,632,473 | 12/1986 | Smith | 312/265.1 |
| 4,719,934 | 1/1988 | Mydans | 52/222 |
| 4,833,805 | 5/1989 | Roberson | 40/603 |
| 4,966,421 | 4/1993 | Mengel | 312/263 X |
| 5,228,762 | 7/1993 | Mascrier | 312/265.1 |

*Primary Examiner*—James R. Brittain
*Assistant Examiner*—Nancy Mulcare
*Attorney, Agent, or Firm*—Kane, Dalsimer, Sullivan, Kurucz, Levy, Eisele and Richard

[57] ABSTRACT

A knock-down cabinet is formed of a plurality of wall panels, each panel being formed of rigid members interconnected to form a frame. A fabric is stretched on the frame to form a side surface for the cabinet. The member may have a tubular cross section and may be extruded from an aluminum or an alloy thereof to form a very light, yet strong cabinet. The cabinet may be provided with similarly constructed trays for holding flat objects.

10 Claims, 3 Drawing Sheets

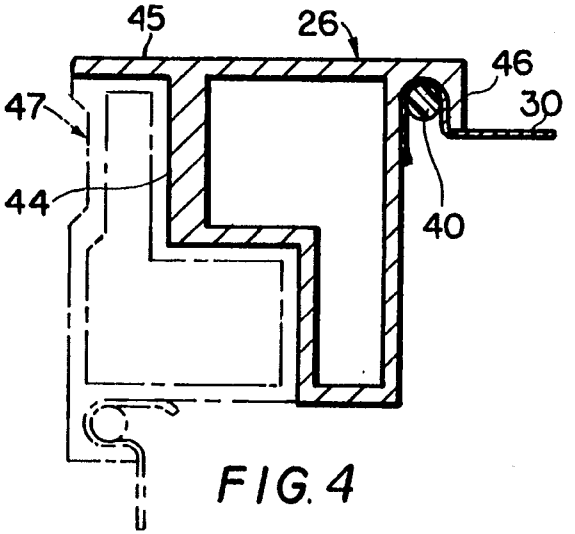
FIG. 5
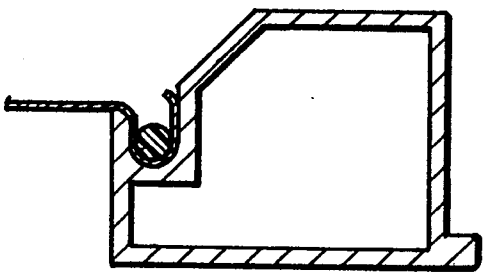
FIG. 7
FIG. 4
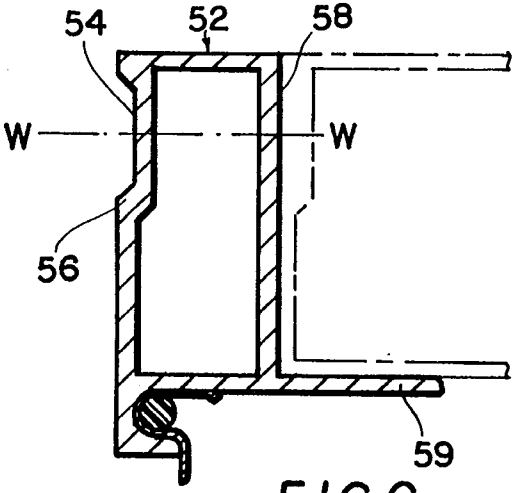
FIG. 6

SITE ERECTABLE CABINET

BACKGROUND OF THE INVENTION

1. Field of Invention

This invention pertains to a light weight cabinet which can be shipped and stored easily in a disassembled configuration, and which may be easily assembled on site when required, and more particularly to a light weight cabinet for storage of various objects.

2. Description of the Prior Art

Cabinets are available from various commercial sources which are shipped from the manufacturing site to the customer in a disassembled configuration and are assembled on site by the customer. A problem with these cabinets is that they are not very strong since they are made of structurally unsound material such wood, plywood, or other wood composites, or sheet metal. Hence, they are not suitable in environments such as warehouses where they may be bumped, dropped or turned over. Moreover, these cabinets are usually not dust tight so that they cannot be used to store objects which need protection from the elements, including for example historical objects. Furthermore, frequently these types of cabinets include several members which are glued together on assembly so that once they are assembled they cannot be readily disassembled for shifting to another site.

Finally, the existing cabinets of the type described above could not be used to store relatively large objects which had to be stored on a flat surface such as flags, garments, maps etc.

OBJECTIVES AND SUMMARY OF THE INVENTION

In view of the above-mentioned disadvantages of the prior art, it is an objective of the present invention to provide a cabinet which is light weight yet structurally strong for protecting its contents.

A further objective is to provide a cabinet which may be readily assembled and disassembled as required without affecting its structural integrity.

Yet a further objective is to provide a cabinet which when assembled is dust tight to protect its contents from the environment.

Other objectives and advantages shall become apparent from the following description.

Briefly, a knockdown cabinet constructed in accordance with this invention consists of several wall panels, each being made of a rigid tubular metal frame. A woven or non-woven material is stretched across the frame to complete a dust-proof wall surface. The wall panels are then removably interconnected to form an enclosure. The enclosure also has an opening for inserting or removing articles. The opening is covered by a door panel which is sealed against the remaining wall panels by sealing means designed to insure that the cabinet is dust proof.

BRIEF DESCRIPTION OF THE DRAWINGS

FIG. 4 shows a cross sectional view of the top wall panel taken along line 4—4 in FIG. 2;

FIG. 5 shows a cross sectional view of a side wall panel taken along line 5—5 in FIG. 1;

FIG. 6 shows a cross-sectional view of the back wall panel taken along line 6—6 in FIG. 1; and FIG. 7 shows a cross-sectional view of the tray taken along line 7—7 in FIG. 1.

DETAILED DESCRIPTION OF THE INVENTION

Figure 2:
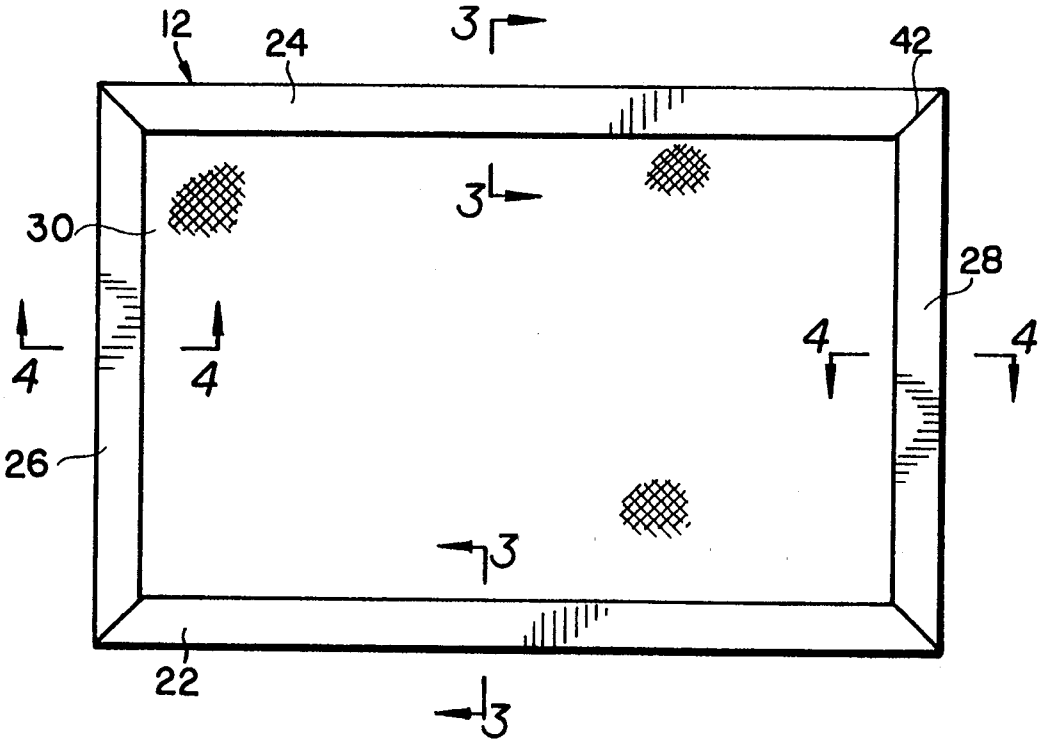
FIG. 2 shows a plane view of the top wall panel.

Referring now to the drawings, a cabinet 10 constructed in accordance with this invention consists of several wall panels, including a top wall panel 12, a bottom wall panel 14, two side panels 16, 18 and a back panel 20. Each of these wall panels includes four tubular members forming a frame across which a woven or non-woven fabric is stretched to complete the wall surface. For example, as shown in FIG. 2, top wall panel 12 includes a front tubular member 22, a back tubular member 24, and side tubular members 26, 28 secured to each other end-to-end to form a generally rectangular frame. For example, the members 22, 24, 26, 28 may be mittered to an angle of 45° and then welded to each other as at 42. A fabric 30 is stretched on the rectangular frame as shown.

Figure 3:
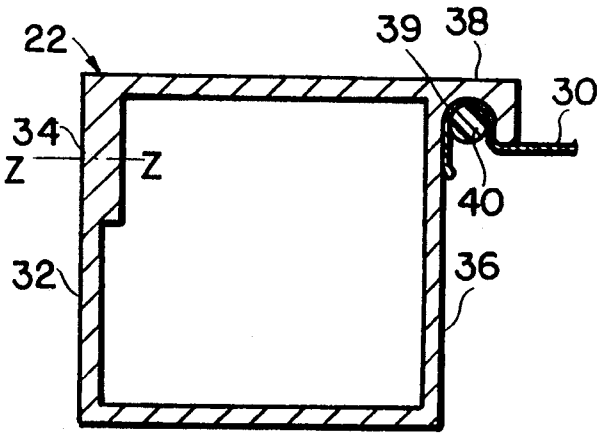
FIG. 3 is a cross sectional view of the top wall member taken along line 3—3 in FIG. 2.

As shown in FIG. 3, the front tubular member 22 is generally square or rectangular cross section formed for example from aluminum, an aluminum alloy or either similar relatively light weight but strong materials. If the member 22 is made of aluminum, it may be advantageously formed by extrusion. Member 22 has a front face 32 with a thickened portion 34 so that this member 22 can be secured to another member by screws or other means as discussed below. In addition, tubular member 22 has also a rear face 36 formed on the top with a hook-shaped overhand 38 defining a channel 39. This channel is sized and shaped to accept a bead 40 made of neoprene or other rubber-like material. Bead 40 is used to mount in channel 39 and stretch fabric 30 as shown.

The back tubular member 24 has substantially the same shape as the front member 22. As shown in FIG. 4, preferably side tubular member 26 is generally L-shaped rather than being square or rectangular as is the case with the front and the back member 22, 24. However, like the front and back members, member 26 also has a front face 44 which is thicker than the rest of the member and a hook shaped lip 46 for holding a bead 40. In addition, above face 44, member 26 has an extension 45 which fits over the side panel member 16 as discussed below. Tubular member 28 has the same cross-sectional shape as tubular member 26.

The side wall panels 16, 18 have the same general structure as the top and bottom wall panels. That is, each of the side wall panels is constructed of four tubular members welded to form a frame and a fabric extended over the frame. As shown in FIG. 5 the top member 47 of side wall panel 16 has an L-shaped cross section similar to side member 26 of top panel 12 so that it fits together with the top member as shown in outline in FIG. 4. Member 47 also has a face 48 which is thicker than the rest of the member. This face 48 is provided with a trapezoidal channel 50. The bottom members of the panels 16, 18 are identical to the top member 47. The side members of the panels 16, 18 are identical to the front and rear members of the top and bottom panels 12, 14, shown in FIG. 3.

Prior to assembly, the wall panels are predrilled at selected locations, such as for example along axes X—X shown in FIG. 4, Y—Y shown in FIG. 5 and Z—Z shown in FIG. 3. The purpose of these holes is discussed below.

The back wall panel 20 is formed similarly of four members welded to form a frame and a fabric stretched over the frame. A cross section for all the members 52 of the back panel 20 is shown in FIG. 6. Each member 52 is essentially L-shaped, with a trapezoidal channel 54 formed on thick face 56. Holes 60 are predrilled in each member 52 along axis W—W passing through the longitudinal axis of the trapezoidal channel 54, as well as through the opposing face 58. Member 52 is also provided with a lip 59 used to mate the back panel with the remaining panels during assembly.

Figure 1:
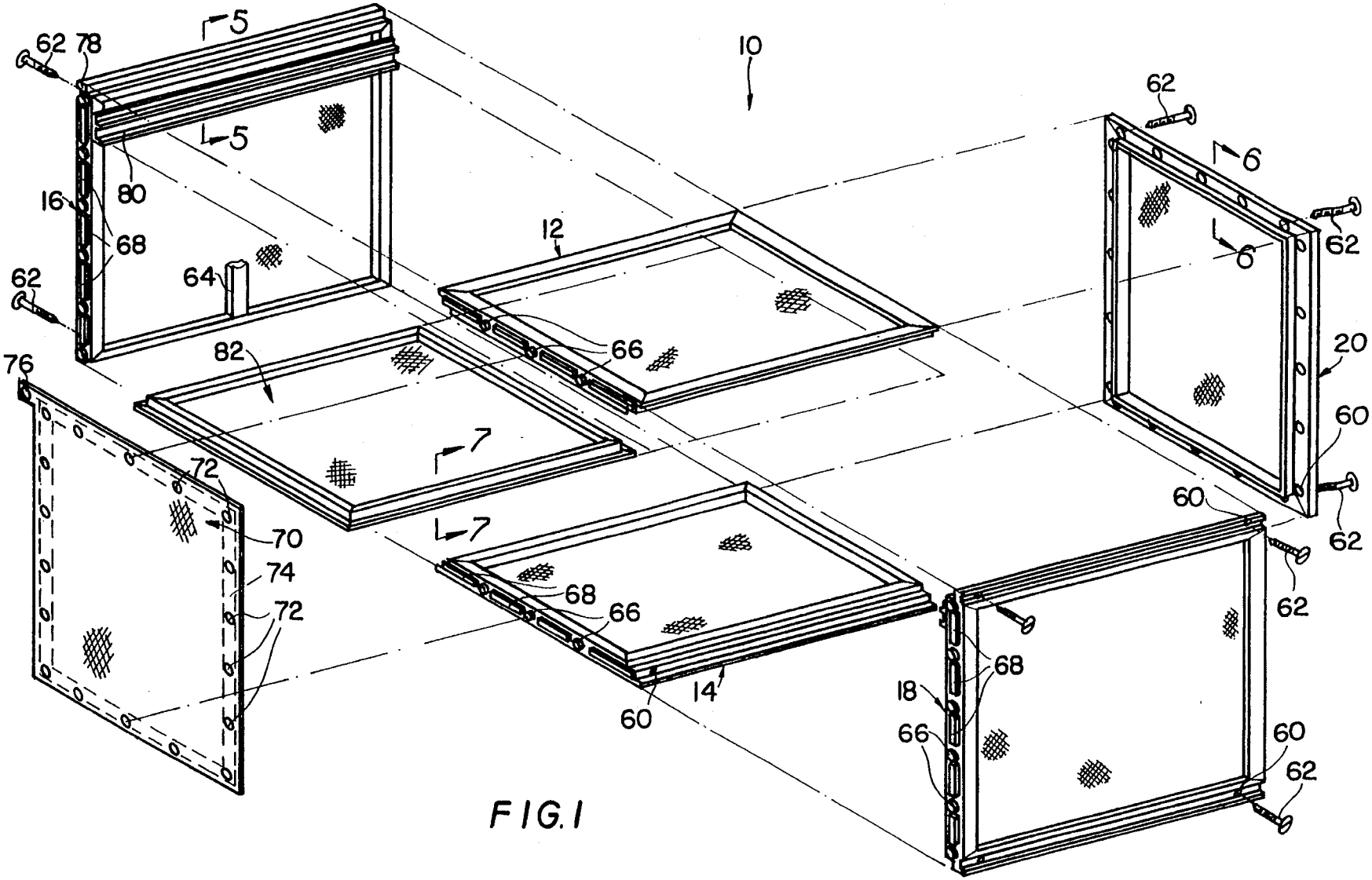
FIG. 1 shows an orthogonal exploded view of a cabinet made in accordance with this invention.

When assembled in the configuration shown in FIG. 1, the various predrilled holes line up. For example, the holes in member 46 along axis Y—Y (FIG. 5) line up with the holes in member 26 along axis X—X. Similarly, the holes in member 52 along axis W—W line up with the holes in member 22 along axis Z—Z. The panels then can be secured to each other for example by inserting self-taping screws 62 into the above-mentioned holes 60. Alternatively, screws 62 may be self-drilling in which case the pre-drilled holes are not required.

For large sized cabinets, reinforcing beams may be added to some of the wall panels. For example in FIG. 1, panel 16 is provided with a reinforcing beam 64.

In this manner the five panels are constructed and assembled to form a cabinet which is opened to the front. A similar panel to the panels described above (such as panel 20) could be constructed and hingedly attached to the top, bottom or side panels as a closure for the cabinet to form a swinging door. However, the cabinet may be constructed and arranged to have a very wide width, for example in the order of 96". For such a wide cabinet a swinging door type closure is impractical because it may be too awkward to handle and if it is side mounted it may block the aisles in a warehouse. Therefore, in the embodiment shown in FIG. 1, the wall panel members facing the front of the cabinet are provided with a plurality of male snap members 66. These snap members may be readily attached to these members by using screws passing through the thick section 34 (FIG. 3). In addition, some, or all the panel members facing the cabinet front are provided with Velcro® strips 68.

For closing the cabinet, a fabric door panel 70 is provided cut and sized to fit over the opening in the cabinet. The panel 70 is provided with female snap members 72 mating with male snap members 66. In addition door panel 70 is also provided with Velcro® strips 74 for mating with strips 68. In this manner the door panel 70 can be easily mounted to the remaining wall panels to thereby form an enclosed cabinet which is dust-proof. In order to open the door panel, its bottom and sides may be disengaged, and the panel may then be folded over and rested on top of the panel 12. For smaller cabinets, panel 70 may also be provided with a ring 76 which passes over a hook 78 on side panel 16 (FIG. 1). In this later configuration, the door panel may be removed and left hanging on the hook 78 while articles are loaded or unloaded to or from the cabinet.

The fabric used for the wall panels, as well as the door panel 70 can be for example a 400 denier nylon woven material.

The cabinet described above is particularly suited for the storage of historical objects which must be rested on a flat surface, such as flags, costumes, etc. For this purpose, the side panels 16, 18 may be provided with clips 80 mounted to hold a plurality of trays 82. Advantageously, each of the trays 82 is formed in the same manner as the wall panel members discussed above. A preferred cross-section for a member used to form the trays is shown in FIG. 7.

The cabinet described above has a number of advantages. First, it is easy to assemble and disassemble merely by inserting or removing screws 62. As it will be appreciated by those skilled in the art this process does not require high technical skills and accordingly can be performed by unskilled personnel.

Because the cabinet is very light and so easy to assemble it can be shipped readily to the customer in a disassembled configuration thereby reducing shipping costs considerably. In the same vain, the customer can readily shift the cabinets from one location to another without requiring any help from the manufacturer.

The cabinets can be made into large sizes to house large objects, especially when the objected have to be rested on a flat surface.

Finally, since all the panels are made using a common manufacturing technique, the cost of manufacturing the whole cabinet is much lower then if some of the elements would have different structures than others.

Obviously numerous modifications may be made to this invention without departing from its scope as defined in the appended claims.

I claim:

1. A cabinet comprising:

a plurality of wall panels, each wall panel including a plurality of panel members interconnected to form a frame, each wall panel further including a fabric attached to said frame; and securing means for securing said plurality of wall panels together to form an enclosure;

wherein each of said panel members consists of a tubular member, said tubular member having a face with a section thicker than the remainder of said tubular member; and wherein said securing means includes screws passing through said section.

2. The cabinet of claim 1 wherein said tubular member is extruded from an aluminum alloy.

3. The cabinet of claim 1 wherein said panel members are hollow each being provided with a coextensive channel and means for securing said fabric into said channel.

4. The cabinet of claim 1 wherein said enclosure has an opening, and wherein said cabinet is further provided with a closure means for closing said opening.

5. A knock-down cabinet comprising:

a plurality of wall panels, each wall panel including a plurality of tubular members interconnected to form a frame, and a fabric mounted on said frame to form a wall surface of said wall panel; and fastener means for removably fastening said wall panels to form an enclosure;

wherein each said tubular member has a face with a section thicker than the remainder of said member, and wherein said fastener means includes screws passing through said section.

6. The cabinet of claim 5 wherein said enclosure has an opening, further comprising closure means for closing said opening.

7. The cabinet of claim 6 further comprising sealing means for sealing said opening.

8. The cabinet of claim 5 further comprising clips attached to said wall panels and trays, said trays being held within said cabinet by said clips for storing flat objects.

9. The cabinet of claim 8 wherein each said tray is formed by tray members interconnected to form a tray frame; and wherein each said tray further includes a tray fabric said tray frame.

10. A cabinet comprising:

a plurality of wall panels, each wall panel including a plurality of tubular members interconnected to form a frame, and a fabric mounted on said frame to form a wall surface of said wall panel;

fastener means for fastening said wall panels to form an enclosure;

a plurality of clips, each clip being attached to one of said wall panels; and a plurality of trays held within said enclosure by said plurality of clips for storing flat objects.

* * * * *